US012631109B2

(12) United States Patent
Jacques et al.

(10) Patent No.: US 12,631,109 B2
(45) Date of Patent: May 19, 2026

(54) METHOD AND SYSTEM FOR ESTIMATING A DEPTH INJECTION PROFILE OF A WELL

(71) Applicant: TOTALENERGIES ONETECH, Courbevoie (FR)

(72) Inventors: Antoine Jacques, Pau (FR); Benoit Brouard, Pau (FR); Vincent Jaffrezic, Pau (FR)

(73) Assignee: TotalEnergies OneTech, Courbevoie (FR)

( * ) Notice: Subject to any disclaimer, the term of this patent is extended or adjusted under 35 U.S.C. 154(b) by 772 days.

(21) Appl. No.: 17/921,959

(22) PCT Filed: Apr. 28, 2020

(86) PCT No.: PCT/IB2020/000403
§ 371 (c)(1),
(2) Date: Oct. 27, 2022

(87) PCT Pub. No.: WO2021/220026
PCT Pub. Date: Nov. 4, 2021

(65) Prior Publication Data

US 2023/0175392 A1 Jun. 8, 2023

(51) Int. Cl.
*E21B 49/00* (2006.01)
*E21B 47/06* (2012.01)

(52) U.S. Cl.
CPC ..... *E21B 49/00* (2013.01); *E21B 47/06* (2013.01)

(58) Field of Classification Search
CPC ..... E21B 49/00; E21B 47/06; E21B 49/008
See application file for complete search history.

(56) References Cited

U.S. PATENT DOCUMENTS 8,583,378 B2 11/2013 Jacques et al.
2010/0121580 A1* 5/2010 Jacques ..... G01V 9/00 702/11
2018/0112522 A1 4/2018 Androvandi et al.

FOREIGN PATENT DOCUMENTS

EP 2 120 068 A1 11/2009
WO 2015/014800 A1 2/2015

OTHER PUBLICATIONS

International Search Report and Written Opinion of the International Searching Authority for Application No. PCT/IB2020/000403, date of mailing Nov. 20, 2020, 9 pages.

(Continued)

*Primary Examiner* — Tarun Sinha
(74) *Attorney, Agent, or Firm* — Seed Intellectual Property Law Group LLP

(57) ABSTRACT

A method for estimating an injection profile in function of the depth of a well include performing, when the well is initially filled with an initial fluid: a well closing phase wherein a first fluid is injected at a first end of the well until said first fluid reaches a second end of the well, said first fluid having a higher viscosity than the initial fluid; and a well opening phase wherein a second fluid is injected at the first end until said second fluid reaches the second end, said first fluid having a higher viscosity than the second fluid. The method further comprises measuring at least one temporal injection profile and estimating the depth injection profile of the well based on the at least one temporal injection profile.

23 Claims, 4 Drawing Sheets

(56) References Cited

OTHER PUBLICATIONS

Jacques, A. et al., "Let's Combine Well Testing and Logging: a Pre and Post Frac Shale Gas Field Case", Unconventional Resources Technology Conference, Jul. 22-24, 2019, 20 pages.
Manivannan, S. et al., "Permeability Logging through Constant Pressure Injection Test: In-Situ Methodology and Laboratory Tests", Society of Petroleum Engineers, Sep. 30-Oct. 2, 2019, 23 pages.

* cited by examiner

METHOD AND SYSTEM FOR ESTIMATING A DEPTH INJECTION PROFILE OF A WELL

BACKGROUND

Technical Field

This disclosure relates to the field of geological formations studies, and relates more particularly to a method and system for estimating the depth injection profile of a well used for reaching an underground geological formation, e.g., such as a well used for recovering hydrocarbons (oil, natural gas, shale gas, etc.) from said geological formation.

Description of the Related Art

A well used for reaching a geological formation usually extends between a first end located towards the surface level, or "wellhead", and a second end opposed to the first end.

Different configurations may exist for such a well.

For instance, immediately after drilling, a well consists in a borehole in the geological formation, with at most the first end cased, the cased portion being usually referred as "shoe" of the well, the rest of the well not being cased. Such a configuration is usually referred to as "open-hole" configuration After it has been drilled, and before considering incurring the costs of casing the well, the well undergoes well testing operations in order to determine if this well will be used for hydrocarbon recovery or abandoned as a dry hole.

If the well testing operations determine that the well may be used for hydrocarbon recovery, then it is cased, from the first end to the second end, in order to, e.g., prevent it from closing upon itself.

A cased-hole configuration usually refers to a configuration in which the casing comprises lateral perforations in order to connect the inner volume of the casing with the geological formation.

Once the well is completed, then it can be used for recovering hydrocarbons from the geological formation, using conventional recovery methods. Sometimes, the well may be used in conjunction with another well, in which case one of the wells is an injection well used to inject a production fluid (such as water or brine) into the geological formation in order to push the hydrocarbons towards the other well, which corresponds to a production well at which the hydrocarbons are recovered.

Also, once the well is completed, and throughout its lifetime, it is important to perform well production logging operations in order to evaluate the actual production or the production potential of the well. Such well production logs can be used to optimize the recovery of hydrocarbons.

Well testing operations usually use tools that are inserted into the well in order to measure and evaluate physical properties of the geological formation along the length of the borehole portion of the well.

For instance, document EP 2120068 A1 describes such a tool used for well testing operations. In document EP 2120068 A1, a tube is inserted down to the second end of the well. The tube defines two volumes inside the well: an inner volume of the tube, and an outer volume of the tube, between the outer surface of the tube and the inner surface of the borehole. These two volumes are in fluidic communication at the second end of the well. Then the well is filled with two fluids and an interface between the two fluids is moved in the outer volume, by injecting a first fluid in the inner volume at the first end of the well, and by extracting a second fluid from the outer volume at the first end, and vice versa. Hence, the fluids are circulated inside the well, from the first end to the second end via the inner volume and from the second end to the first end via the outer volume, and vice versa. By disturbing the hydraulic balance of the fluids inside the well, and by measuring effects of said disturbance of the hydraulic balance, the solution proposed enables to estimate physical properties of the borehole portion of the well. These estimated physical properties may be used to determine whether the well should be cased or not.

A drawback of the solution described by document EP 2120068 A1 lies in the fact that it necessarily requires inserting a tool (tube) inside the well. Indeed, the operations of inserting and removing the tube are both costly and risky for the operators manipulating the tube. Also, this solution cannot be applied to wells comprising slanted or horizontal portions.

Well production logging operations usually use tools that are inserted into the well in order to measure and evaluate physical properties of the well. Another solution consists in embedding sensors along the entire length of the casing of the well, in order to be able to measure directly, at any depth of the well, physical quantities representative of physical properties of the well.

A drawback of such well production logging solutions is that they are costly. When a tool needs to be inserted in the well, such solutions are also risky, as for the solution described by document EP 2120068 A1 and cannot be applied to wells comprising slanted or horizontal portions. It should be noted that, in some cases, the solution described by EP 2120068 A1 cannot be applied as such for well production logging operations because not all cased wells have large enough inner sections for inserting a tube and circulating fluids inside them.

BRIEF SUMMARY

The present disclosure aims at improving the situation. In particular, the present disclosure aims at overcoming at least some of the limitations of the prior art discussed above, by proposing a solution for estimating a depth injection profile of a well without requiring inserting a tool inside the well, requiring only measuring physical quantities at the first end of the well.

Also, in some embodiments, the present disclosure aims at proposing a solution for evaluating the consistency of the measurements made, and consequently evaluating the accuracy of the depth injection profile estimated.

According to a first aspect, the present disclosure relates to a method for estimating an injection profile in function of the depth of a well, said well being used for reaching a geological formation, the well extending between a first end of the well and a second end of the well, said first end being located towards the surface level, wherein said method comprises performing, the well being initially filled with an initial fluid:

- a well closing phase wherein a first fluid is injected at the first end until said first fluid reaches the second end, such that a first interface between the initial fluid and the first fluid travels from the first end towards the second end, the well being filled with the first fluid when the first interface reaches the second end, said first fluid having a higher viscosity than the initial fluid;
- a well opening phase wherein a second fluid is injected at the first end until said second fluid reaches the second end, such that a second interface between the first fluid and the second fluid travels from the first end towards the second end, the well being filled with the second fluid when the second interface reaches the second end, said first fluid having a higher viscosity than the second fluid;

wherein the method comprises measuring at least one temporal injection profile representative of the variation over time of at least one physical quantity measured at the first end during the well closing phase or the well opening phase, and estimating the depth injection profile of the well based on the at least one temporal injection profile.

Hence, the estimating method performs successively a well closing phase and a well opening phase, by injecting successively, in the well initial filled with an initial fluid, a first fluid until the well is completely filled with said first fluid, and then a second fluid until the well is completely filled with said second fluid, both the second fluid and the initial fluid having a lower viscosity than the first fluid. It is emphasized that the first and second fluids are injected directly at the first end (i.e., the wellhead) without any tube inside the well. Hence, when injecting the first fluid, the first interface between the first fluid and the initial fluid, which covers a whole section of the well, travels from the first end until it reaches the second end. The initial fluid is not circulated inside the well (as in EP 2120068 A1) and, when the first interface reaches the second end, the initial fluid has been completely expelled from the well and injected into the geological formation. Similarly, when injecting the second fluid, the second interface between the second fluid and the first fluid, which covers a whole section of the well, travels from the first end until it reaches the second end. The first fluid is not circulated inside the well and, when the second interface reaches the second end, the first fluid has been completely expelled from the well and injected into the geological formation.

During at least one among the well closing phase and the well opening phase, a temporal injection profile is measured. The measured temporal injection profile is representative of the variation over time of at least one physical quantity related to the first fluid or of the second fluid. The at least one physical quantity measured, which may be, e.g., the injection pressure and/or the injection flowrate, is measured at the first end, i.e., at the surface level. Hence, no underground sensors are required inside the well, such that the at least one physical quantity can be measured in a cost-effective manner.

Preferably, the viscosity of the first fluid is at least 10 times higher than the viscosity(ires) of the initial fluid and/or of the second fluid, or even at least 20 times or 30 times higher.

Due to the difference between the first fluid's viscosity and the viscosities of the second fluid and of the initial fluid, the local injectivities in a portion of the well will not be the same for all the fluids. When the first interface (resp. the second interface) spans a given portion of the well, the variation at the first end of the injection flowrate of the first fluid (resp. the second fluid) is substantially equal to the variation of local injectivity due to the replacement in this portion of the initial fluid by the first fluid (resp. of the first fluid by the second fluid). The variation of local injectivity is basically the difference between the local injectivity of the initial fluid and the local injectivity of the first fluid (resp. the difference between the local injectivity of the first fluid and the local injectivity of the second fluid), which depends on the respective viscosities of the fluids. For instance, if the injection flowrate of the first fluid (resp. second fluid), and its variations over time, are measured at the first end, then the at least one temporal injection profile is representative of the variations over time of the local injectivity due to the displacement of the first interface (resp. second interface) inside the well, which can be converted into a variation over depth of the local injectivity, i.e., converted into a depth injection profile.

Basically, it suffices to measure one temporal injection profile, either during the well closing phase or during the well opening phase. If the viscosity of the initial fluid is not known with enough accuracy (for instance if the initial fluid is drilling mud), it might be preferable to measure the temporal injection profile over the well opening phase. It is also possible to measure the temporal injection profile only during the well closing phase, in which case the main purpose of the well opening phase may be to, e.g., return the well to its initial state, assuming that the initial fluid and the second fluid are identical fluids.

Accordingly, the proposed estimating method reduces the costs and risks with respect to prior art solutions and may be applied to any well regardless its diameter, provided that the well is injective (i.e., that the initial fluid and the first fluid can be injected into the geological formation).

In specific embodiments, the estimating method can further comprise one or more of the following features, considered either alone or in any technically possible combination.

In specific embodiments, the depth injection profile is further estimated based on an a priori knowledge of depths along the well at which modifications of the at least one physical quantity measured can occur.

In specific embodiments, the estimating method comprises, when measuring the at least one temporal injection profile, estimating successively in time the depth of the first interface or of the second interface, wherein the depth injection profile is further estimated based on the estimated depth over time of the first interface or of the second interface.

In specific embodiments, estimating the depth of the first interface or of the second interface comprises measuring the propagation time of an echo of an acoustic wave propagating inside the well, and estimating the depth of the first interface or of the second interface based on the measured propagation time.

In specific embodiments, a first temporal injection profile is measured for the first fluid during the well closing phase and a second temporal injection profile is measured for the second fluid during the well opening phase, and the depth injection profile of the well is estimated based on both the first temporal injection profile and the second temporal injection profile.

Indeed, it might be advantageous to measure one temporal injection profile for each of the well closing phase and the well opening phase. Since each of these temporal injection profiles is representative of the depth injection profile, then improved accuracy is expected by using multiple temporal injection profiles for estimating the depth injection profile.

In specific embodiments, a first depth injection profile is estimated based on the first temporal injection profile and a second depth injection profile is estimated based on the second temporal injection profile, and the depth injection profile of the well is estimated based on both the first depth injection profile and the second depth injection profile. For instance, the depth injection profile is obtained by combining the first depth injection profile with the second depth injection profile, e.g., by computing a mean depth injection profile of said first and second depth injection profiles.

In specific embodiments, a first depth injection profile is estimated based on the first temporal injection profile and a second depth injection profile is estimated based on the second temporal injection profile, and the method comprises evaluating consistency of the measurements of the at least one physical quantity by comparing the first depth injection profile and the second depth injection profile. Indeed, if the first and second depth injection profiles are not similar, then it implies that at least one of said first and second injection profiles is not correct, such that the measurements cannot be considered consistent. In turn, if the first and second depth injection profiles are similar, then the measurements can be considered consistent, and the depth injection profile can be estimated based on either the first depth injection profile or the second depth injection profile or both.

In specific embodiments:

the first fluid is a gel; and/or the second fluid is water or brine.

In specific embodiments, the initial fluid has the same viscosity as the second fluid. Preferably, the initial fluid and the second fluid are identical fluids.

In specific embodiments, the first fluid has the same density as the second fluid and/or the first fluid has the same density as the initial fluid. In the present disclosure, two fluids have the same density if the absolute value of the difference between their respective density values is lower than 10% of the highest density value among said density values.

In specific embodiments, measuring the at least one temporal injection profile comprises:

measuring the injection flowrate at the first end of the first or second fluid while maintaining a constant injection pressure at the first end during at least a part of the well closing phase or of the well opening phase; or measuring the injection pressure at the first end of the first or second fluid while maintaining a constant injection flowrate at the first end during at least a part of the well closing phase or of the well opening phase.

In specific embodiments, measuring the at least one temporal injection profile is performed over successive time intervals having different respective constant injection pressure setpoints or different respective constant injection flowrate setpoints.

According to a second aspect, the present disclosure relates to a computer program product comprising code instructions which, when executed by a processor, cause said processor to carry out the step, of an estimating method according to any one of the embodiments of the present disclosure, whereby the depth injection profile of the well is estimated based on the at least one temporal injection profile.

According to a third aspect, the present disclosure relates to a computer-readable storage medium comprising code instructions which, when executed by a processor, cause said processor to carry out the step, of an estimating method according to any one of the embodiments of the present disclosure, whereby the depth injection profile of the well is estimated based on the at least one temporal injection profile.

According to a fourth aspect, the present disclosure relates to a method for recovering hydrocarbons from a geological formation, said method using a well for reaching the geological formation for performing hydrocarbon recovery, the well extending between a first end of the well and a second end of the well, said first end being located towards the surface level, wherein said method comprises:

estimating a depth injection profile of the well by using an estimating method according to any one of the embodiments of the present disclosure; and using the estimated depth injection profile for the hydrocarbon recovery from the geological formation.

According to a fifth aspect, the present disclosure relates to a system for estimating a depth injection profile of a well, said well being used for reaching a geological formation, the well extending between a first end of the well and a second end of the well, said first end being located towards the surface level, wherein the system comprises means configured for implementing an estimating method according to any one of the embodiments of the present disclosure.

According to a fifth aspect, the present disclosure relates to a system for recovering hydrocarbons from a geological formation, said system comprising:

a well used for reaching the geological formation, the well extending between a first end of the well and a second end of the well, said first end being located towards the surface level; and a depth injection profile estimating system according to any one of the embodiments of the present disclosure.

In specific embodiments, the well comprises a casing extending between the first end and the second end, said casing comprising lateral perforations for connecting an inner volume of the casing with the geological formation.

BRIEF DESCRIPTION OF THE SEVERAL VIEWS OF THE DRAWINGS

The disclosure will be better understood upon reading the following description, given as an example that is in no way limiting, and made in reference to the figures which show.

In these figures, references identical from one figure to another designate identical or analogous elements. For reasons of clarity, the elements shown are not to scale, unless explicitly stated otherwise.

DETAILED DESCRIPTION

As discussed above, the present disclosure relates inter alia to a method and system for estimating a depth injection profile of a well 10. Also, the well 10 may be any well suitable for recovering underground resources, although the present disclosure finds a preferred application in the field of wells used for recovering hydrocarbons (oil, natural gas, shale gas, etc.) from underground geological formations.

Also, the present disclosure is not limited to a specific well configuration and can be applied to, e.g., an open-hole configuration, a cased hole configuration, etc., provided that the well 10 is injective. For instance, an unconventional well might not be injective before fracturation, in which case the present disclosure may be applied to such wells only after fracturation.

Also, the present disclosure is not limited to a specific geometric configuration for the well, and can be applied to wells comprising vertical, slanted or horizontal portions, or any combination thereof.

In the following description, the case of a vertical well 10 having a cased-hole configuration is considered, as a non-limitative example.

Figure 1:
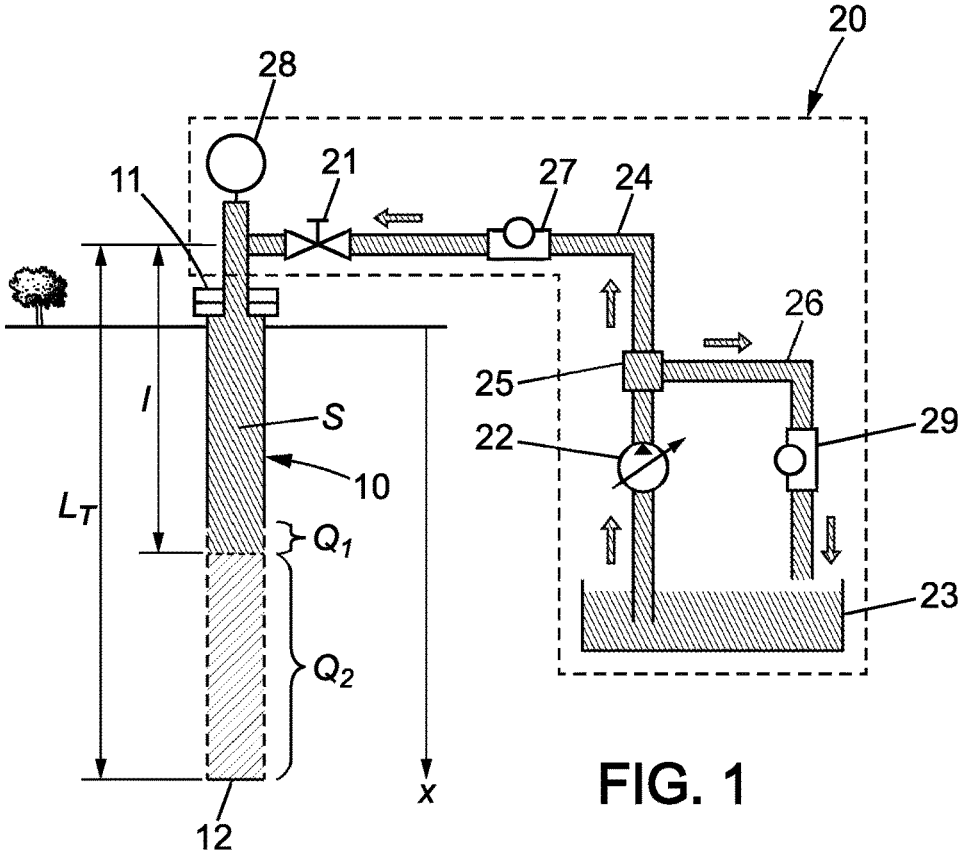
FIG. 1 is a schematic representation of a cross-sectional view of a well for which a depth injection profile is to be estimated.

FIG. 1 represents schematically a cross-sectional view of a well 10 for which a depth injection profile is to be estimated, said well 10 being used for reaching an underground geological formation.

As illustrated by FIG. 1, the well 10 extends between a first end 11 located towards the surface level (or "wellhead"), and a second end 12, opposed to the first end 11 and located underground (or "well bottom").

In the present disclosure, the depth of a given point of the well 10 corresponds to the length measured along the well 10 between said given point of the well 10 and a reference point of the well 10 located towards the surface level, which reference point may be the first end 11 of the well 10. The depth considered herein is sometimes referred to as measured depth or MD in the literature. Hence, in the present disclosure, the depth injection profile to be estimated is a function of the depth (MD) measured along the well 10.

It should be noted that, in most cases (e.g., if the well 10 is not completely vertical), the depth (MD) of a given point of the well 10 is different from the actual depth of this given point, which corresponds to the distance measured vertically between the surface level (or the sea level) and said given point of the well 10. This actual depth is sometimes referred to as true vertical depth or TVD in the literature.

As mentioned above, the well 10 is considered to have a cased-hole configuration and comprises a casing 13. In the example illustrated by FIG. 1, the well 10 is completely cased, and the casing 13 extends from the first end 11 to the second end 12 of the well 10. For instance, the casing 13 may be made of cement and/or metal (e.g., steel, etc.), etc. The casing 13 further comprises lateral perforations 14 which are distributed along the depth of the well 10. In general, the distribution of the perforations 14 is not uniform, and the perforations 14 may be locally grouped. Such groups of collocated perforations 14 are usually referred to as "clusters" in the literature.

FIG. 1 shows also components of a system 20 for estimating the depth injection profile of the well 10.

The system 20 for estimating the depth injection profile comprises means for injecting fluids at the first end 11 of the well 10, and means for measuring, at the first end 11, at least one temporal injection profile representative of the variation over time of at least one physical quantity related to the fluid injected into the well 10.

In the example illustrated by FIG. 1, the injecting means comprise a valve 21, a pump 22 and a tank 23 containing the fluid to be injected into the well 10, connected by a line 24. In this example, it is assumed that the fluid is injected by controlling the injection pressure, and the injecting means comprise also a pressure regulator 25 between the valve 21 and the pump 22, connected also to a bypass line 26 for reinjecting the excess of fluid into the tank 23.

In the example illustrated by FIG. 1, the measuring means comprise a flowmeter 27 in the line 26, for measuring the injection flowrate of the fluid into the well 10, and a pressure sensor 28, for measuring the injection pressure at the first end 11. In this example, the measuring means comprise also a bypass flowmeter 29 for measuring the flowrate in the bypass line 26.

It should be noted that, as will be discussed below, at least two different fluids are successively injected into the well 10. Hence, it is possible to use the same injecting means and measuring means for both different fluids or duplicate all or part of the injecting means and measuring means represented in FIG. 1 for the other fluid. Also, the injecting means and measuring means represented in FIG. 1 correspond to an exemplary configuration, but other configurations are possible for said injecting means and measuring means.

The system 20 for estimating the depth injection profile comprises also means for estimating the depth injection profile of the well 10 based on the at least one temporal injection profile. These estimating means (not represented in the figures) correspond for instance to a processing circuit comprising one or more processors and storage means (magnetic hard disk, solid-state disk, optical disk, etc.) in which a computer program product is stored, in the form of a set of program-code instructions to be executed in order to estimate the depth injection profile of the well 10. Alternatively, or in combination thereof, the processing circuit can comprise one or more programmable logic circuits (FPGA, PLD, etc.), and/or one or more specialized integrated circuits (ASIC), and/or a set of discrete electronic components, etc., adapted for implementing all or part of the operations for estimating the depth injection profile.

As illustrated by FIG. 1, it is emphasized that the fluids injected for estimating the depth injection profile of the well 10 are injected directly at the first end 11, without any tube or tool inside the well. Hence, any fluid injected at the first end 11 will travel inside the well 10 from the first end 11 towards the second end 12 of the well 10. No circulation of the fluid occurs inside the well 10, and the injected fluid is injected into the geological formation through the perforations 14 of the casing 13 of the well 10.

Figure 2:
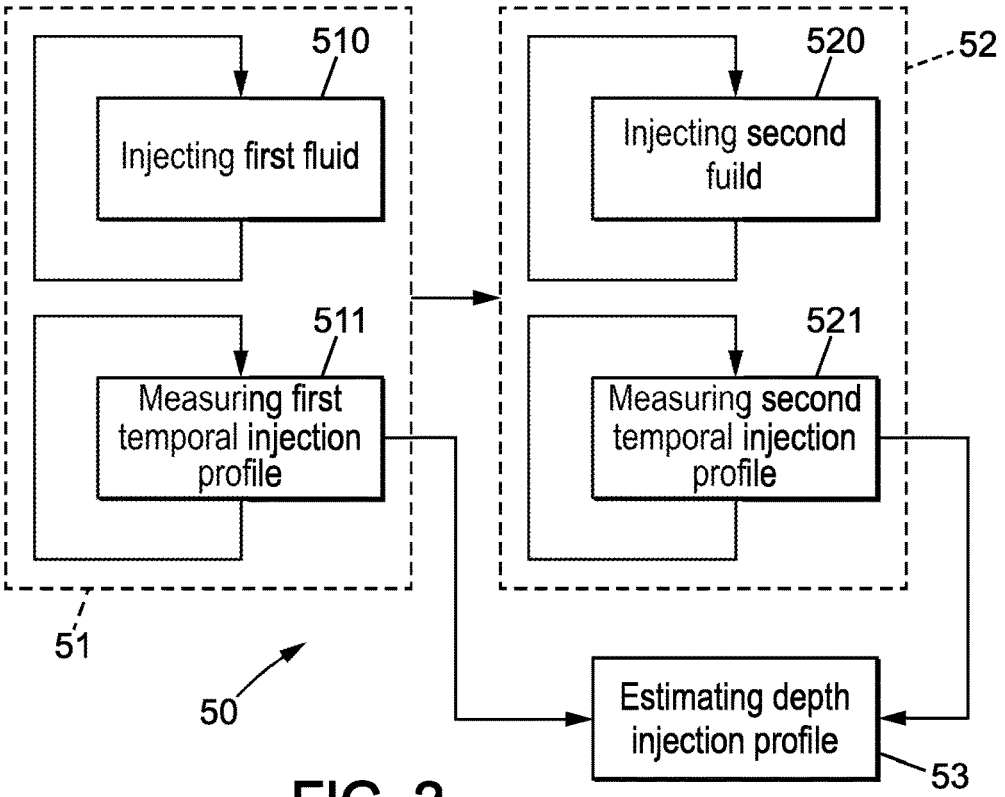
FIG. 2 is a flow chart illustrating the main steps of a method for estimating a depth injection profile of a well.

FIG. 2 represents a flow chart illustrating the main steps of a method 50 for estimating a depth injection profile of the well 10. The well 10 is assumed to be initially filled with an initial fluid 30. In the case of a cased-hole well 10, used for recovering hydrocarbons, the initial fluid 30 may be for instance a non-viscous fluid such as water or brine.

As illustrated by FIG. 2, the estimating method 50 comprises two successive phases during which fluids are injected into the well 10.

First, the estimating method 50 comprises a well closing phase 51. The well closing phase 51 comprises a step 510 of injecting a first fluid 31 at the first end 11 of the well 10 (without any tube or tool). The first fluid 31 has a higher viscosity than the initial fluid 30. Preferably, the first fluid 31 is a viscous fluid such as a gel. Preferably, the ratio between the viscosity of the first fluid 31 and the viscosity of the initial fluid 30 is equal to or higher than thirty (30), for instance around fifty (50).

The first fluid 31 is injected continuously into the well 10 until said first fluid 31 reaches the second end 12 and fills completely the well 10, the initial fluid 30 having been pushed into the geological formation by the first fluid 31.

After the well closing phase 51, the estimating method 50 comprises a well opening phase 52. The well opening phase 52 comprises a step 520 of injecting a second fluid 32 at the first end 11 of the well 10 (without any tube or tool). The second fluid 32 has a lower viscosity than the first fluid 31. Preferably, the second fluid 32 is a non-viscous fluid such as water or brine and may be identical to the initial fluid 30. For instance, the viscosity of the second fluid 32 (and/or of the initial fluid 30) is lower than 2 centipoises (cP, one cP being equal to one millipascal-second-mPa·s), and the viscosity of the first fluid 31 is higher than 30 cP. Preferably, the ratio between the viscosity of the first fluid 31 and the viscosity of the second fluid 32 is equal to or higher than thirty (30), for instance around fifty (50). Preferably, the first fluid 31 and the second fluid 32 (and, optionally, the initial fluid 30) have the same density. The second fluid 32 is injected continuously into the well 10 until said second fluid 32 reaches the second end 12 and fills completely the well 10, the first fluid 31 having been pushed into the geological formation by the second fluid 32. If the second fluid 32 and the initial fluid 30 are identical fluids, then the well 10 has returned to its initial state at the end of the well opening phase 52.

Figure 3:
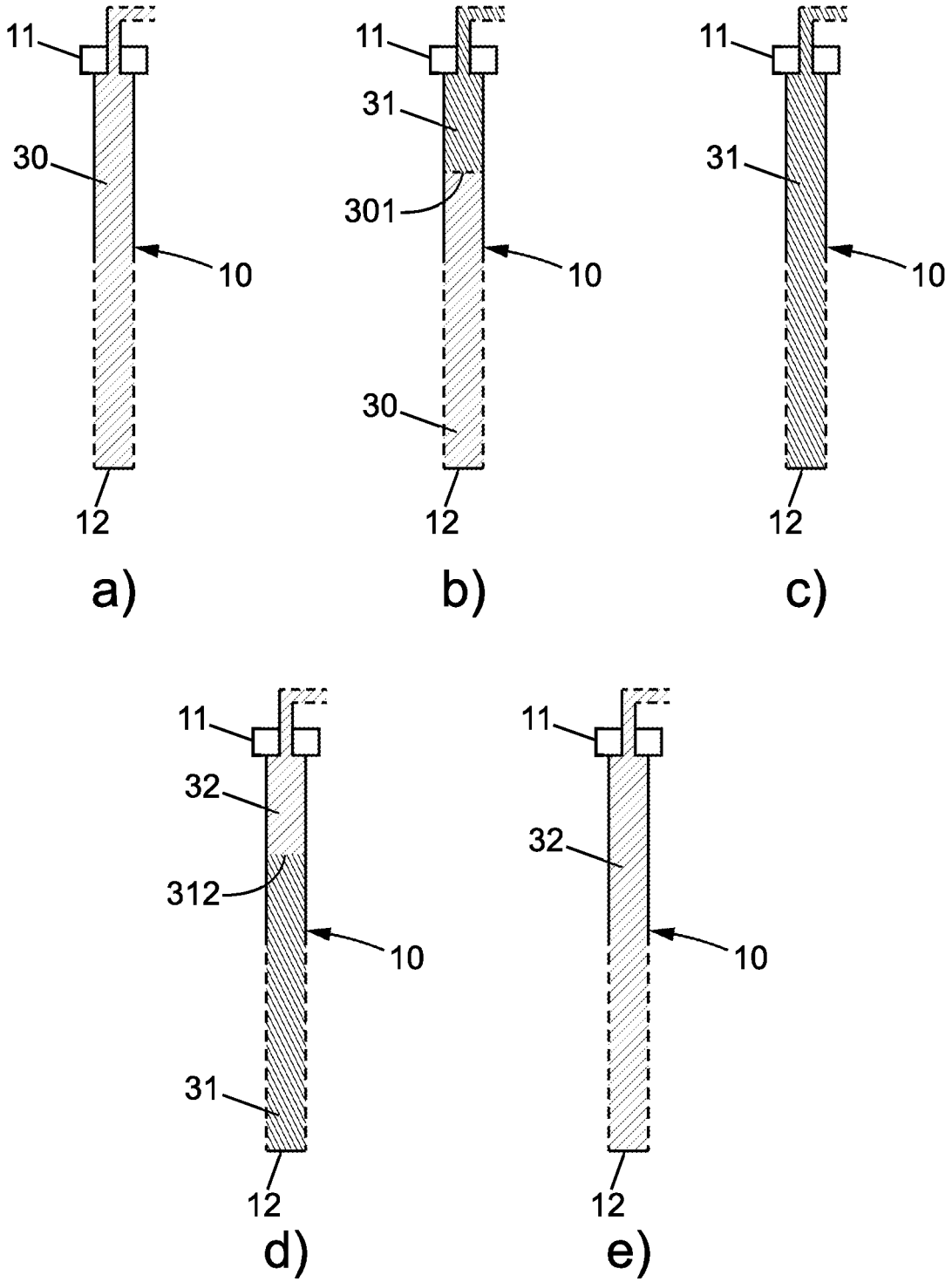
FIG. 3 are schematic representations of cross-sectional views of the well during a well closing phase and a well opening phase of the estimating method.

FIG. 3 represents schematically cross-sectional views of the well during the well closing phase 51 and the well opening phase 52.

In part a) of FIG. 3, the well 10 is completely filled with the initial fluid 30. In part b) of FIG. 3, the injection of the first fluid 31 has started. The first fluid 31 and the initial fluid 30 have different viscosities and are immiscible, such that a first interface 301 between the initial fluid 30 and the first fluid 31 appears inside the well 10. Since no tube or tool is used, the first interface 301 extends over a whole inner section of the well 10. The first interface 301 travels from the first end 11 of the well 10 towards the second end 12 as the first fluid 31 is injected into the well 10. In part c) of FIG. 3, the first interface 301 has reached the second end 12. The well 10 is completely filled with the first fluid 31 and the initial fluid 30 has been completely injected into the geological formation. In part d) of FIG. 3, the injection of the second fluid 32 has started. The second fluid 32 and the fluid first 31 have different viscosities and are immiscible, such that a second interface 312 between the first fluid 31 and the second fluid 32 appears inside the well 10. Since no tube or tool is used, the second interface 312 extends over a whole inner section of the well 10. The second interface 312 travels from the first end 11 of the well 10 towards the second end 12 as the second fluid 32 is injected into the well 10. In part e) of FIG. 3, the second interface 312 has reached the second end 12. The well 10 is completely filled with the second fluid 32 and the first fluid 31 has been completely injected into the geological formation.

During at least one among the well closing phase 51 and the well opening phase 52, the estimating method 50 comprises a step 511, 521 of measuring at the first end 11 of the well 10 at least one temporal injection profile representative of the variation over time of at least one physical quantity related to the first fluid 31 or to the second fluid 32.

For instance, the physical quantity measured successively over time may be the injection pressure and/or the injection flowrate at the first end 11 of the well 10, for the first fluid 31 or the second fluid 32.

According to a first example, it is possible to measure the injection flowrate at the first end 11 of the well 10 while maintaining a constant injection pressure at said first end 11 of the well 10, during all or part of the considered phase, i.e., the well closing phase 51 and/or the well opening phase 52.

It should be noted that maintaining a constant injection pressure can be performed by time intervals. More specifically, it is possible to consider successive time intervals and to define different respective constant injection pressure setpoints for these time intervals. For instance, during the well closing phase 51, the constant injection pressure setpoints may increase over time, i.e., the constant injection pressure setpoint of a time interval is lower than the constant injection pressure setpoint(s) of the following time interval(s). This is advantageous in that it may speed up the well closing phase 51. Indeed, since the first fluid 31 is viscous, the speed of the first interface 301 will decrease over time as the amount of first fluid 31 inside the well 10 increases, under a constant injection pressure at the first end 11. By increasing the constant injection pressure setpoint, the speed of the first interface 301 will also be increased, thereby accelerating the well closing phase 51, etc. Analogously, during the well opening phase 52, it is possible to consider constant injection pressure setpoints that decrease over time, since the speed of the second interface 312 will increase over time as the amount of second fluid 32 inside the well 10 increases, under a constant injection pressure at the first end 11. If the speed of the second interface becomes too important, the measurements might be less accurate. Hence, by reducing the constant injection pressure setpoints over time during the well opening phase 52, the beginning of the well opening phase 52 can be accelerated, and the accuracy of the measurements is maintained during the whole well opening phase 52.

According to a second example, it is possible to measure the injection pressure at the first end 11 of the well 10 while maintaining a constant injection flowrate at said first end 11 of the well, during all or part of the considered phase, i.e., the well closing phase 51 and/or the well opening phase 52.

As discussed above, maintaining a constant injection flowrate can be performed by time intervals. More specifically, it is possible to consider successive time intervals and to define different respective constant injection flowrate setpoints for these time intervals, with the same advantages as those mentioned above when discussing the constant injection pressure setpoints.

It should be noted that other physical quantities can be measured, alternatively or in combination with the injection pressure and/or the injection flowrate, as long as the measured physical quantity has a variation over time during the well closing phase 51 and/or the well opening phase 52 that is representative of the variation of injectivity of the well 10 along its depth. Also, when measuring one among the injection pressure and the injection flowrate, the other physical quantity among the injection pressure and the injection flowrate needs not necessarily to be maintained at a constant value.

In the non-limitative example illustrated by FIG. 2, the well closing phase 51 comprises a step 511 of measuring a first temporal injection profile, and the well opening phase 52 comprises a step 521 of measuring a second temporal injection profile.

Figure 4:
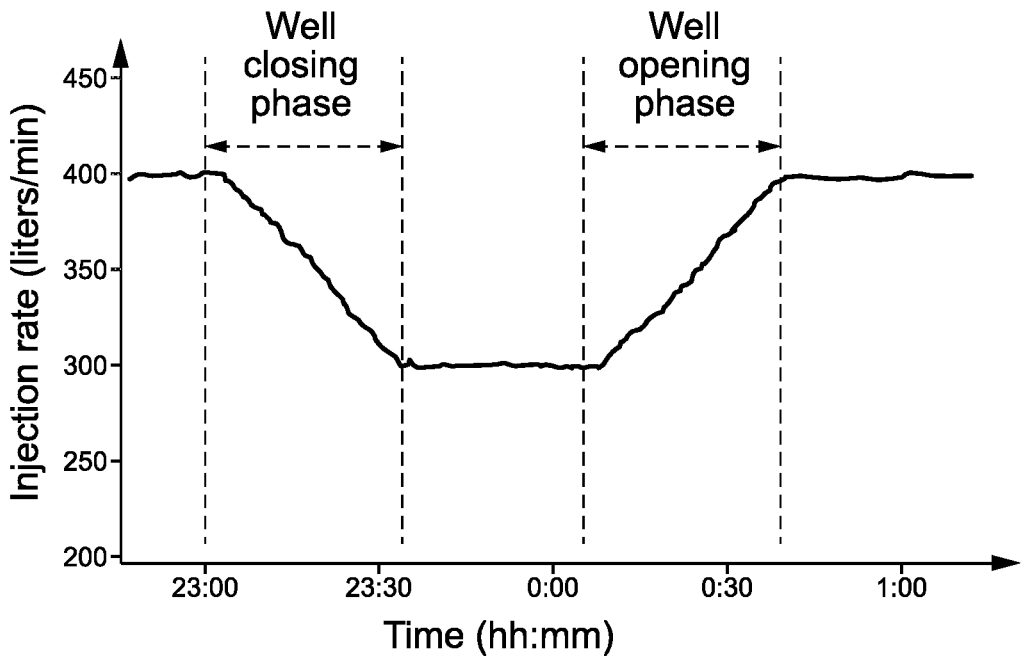
FIG. 4 is a graph illustrating the variation over time of an injection flowrate measured during the well closing phase and the well opening phase.

FIG. 4 represents a graph illustrating an example of first and second temporal injection profiles that can be measured for a well 10.

In FIG. 4, the physical quantity measured corresponds to the injection flowrate at the first end 11 of the well 10, and the measurements are assumed to be carried out while maintaining a constant injection pressure at the first end 11 of the well 10. As can be seen in FIG. 4, the variation over time of the injection flowrate shows that the injection flowrate starts decreasing when the well closing phase 51 begins. This is because the first fluid 31 has a higher viscosity than the initial fluid 30, such that the more the first fluid 31 replaces the initial fluid 30 inside the well 10, the lower the amount of fluid injected into the geological formation. The injection flowrate decreases until the well closing phase 51 ends, i.e., when the first fluid 31 has completely replaced the initial fluid 30 inside the well 10. Then, the injection flowrate starts increasing when the well opening phase 52 begins. This is because the second fluid 32 has a lower viscosity than the first fluid 31, such that the more the second fluid 32 replaces the first fluid 31 inside the well 10, the higher the amount of fluid injected into the geological formation. The injection flowrate increases until the well opening phase 52 ends, i.e., when the second fluid 32 has completely replaced the first fluid 31.

Of course, similar behaviors can be observed when considering other measured physical quantities, for instance when measuring the injection flowrate while maintaining a constant injection pressure at the first end 11.

As illustrated by FIG. 2, the estimating method 50 then comprises a step 53 of estimating the depth injection profile of the well 10 based on the at least one temporal injection profile measured. The estimating step 53 is executed by the estimating means of the estimating system 20.

If two temporal injection profiles have been measured, i.e., a first temporal injection profile for the well closing phase 51 and a second temporal injection profile for the well opening phase 52, then the depth injection profile may be estimated based on either the first temporal injection profile or the second temporal injection profile or both.

In the latter case, a first depth injection profile can be estimated based on the first temporal injection profile and a second depth injection profile can be estimated based on the second temporal injection profile.

Figure 5:
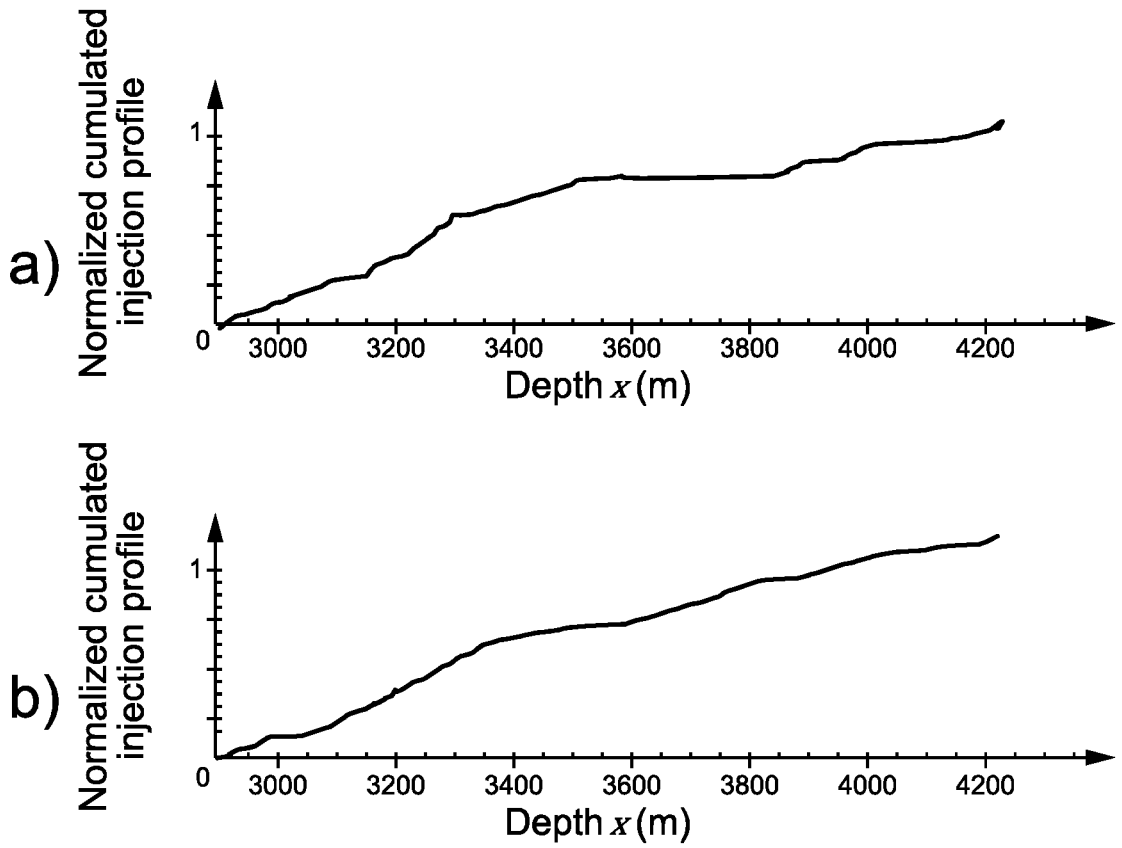
FIG. 5 are graphs illustrating a first depth injection profile obtained for the well closing phase and a second depth injection profile obtained for the well opening phase.

FIG. 5 represents graphs illustrating a first depth injection profile obtained for the well closing phase 51 (part a) of FIG. 5) and a second depth injection profile obtained for the well opening phase 52 (part b) of FIG. 5), based on respectively the first temporal injection profile and the second temporal injection profile represented in FIG. 4. In FIG. 5, the first depth injection profile and the second depth injection profile are represented as cumulative injection profiles which provide, for each depth (MD) x of the well 10, the cumulated injectivity of the portion of the well 10 between the first end 11 and the depth x. Also, the cumulative injection profiles are normalized, such that the cumulated injectivity between the first end 11 and the second end 12 is equal to 1.

As can be seen in FIG. 5, the first depth injection profile and the second depth injection are similar. Hence, the measurements can be considered consistent, and the depth injection profile can be estimated based on either the first depth injection profile or the second depth injection profile or both. If the first depth injection profile and the second depth injection were not similar, then it would imply that at least one of said first and second injection profiles would not be correct, and the measurements would not be considered consistent, requiring maybe other measurements to be made.

According to a specific embodiment, when both a first depth injection profile and a second depth injection profile are estimated, then the final depth injection profile may be estimated by combining said first and second depth injection profiles. For instance, the depth injection profile of the well 10 may be estimated by computing a weighted mean of said first and second depth injection profiles. However, it is also possible to use only one among the first depth injection profile and the second depth injection profile to obtain the final depth injection profile. For instance, the final depth injection profile may be chosen to correspond to the less noisy injection profile among the first depth injection profile and the second depth injection profile.

The step 53 of estimating the depth injection profile of the well 10 based on at least one temporal injection profile may for instance use an a priori partial knowledge of the depth injection profile of the well 10. By "partial knowledge of the depth injection profile", we mean a knowledge of the depths along the well 10 at which modifications of the local injectivity are likely to occur (the values of the local injectivity need not to be known). The depth injection profile of the well 10 may be estimated by correlating the variations of the at least one temporal injection profile with the depths at which modifications are likely to occur.

In the sequel, we provide an example of how the a priori partial knowledge of the depth injection profile of the well 10 may be used in order to convert the at least one temporal injection profile into an estimated depth injection profile. The following example assumes in a non-limitative manner that the well 10 has a cased-hole configuration with several clusters of perforations 14. In the case of a well 10 having a cased-hole configuration, the depths (MD) of the clusters of perforations 14 are usually known a priori and can be used as an a priori partial knowledge of the depth injection profile of the well 10. The following example also assumes that the temporal injection profile has been measured during the well closing phase 51. Although not detailed herein, the following example may also be adapted to the case of a temporal injection profile measured during the well opening phase 52.

During the well closing phase 51, the well 10 is initially filled with the initial fluid 30 which is progressively replaced by the first fluid 31. It is assumed that the first fluid 31 is injected while maintaining a constant injection pressure $P^{wh}$ at the first end 11. The total injectivity of the first fluid 31 (e.g., in liters per minute) into the geological formation is denoted $Q_1$ and the total injectivity of the initial fluid 30 into the geological formation is denoted $Q_2$. The total depth (MD) of the well 10 is denoted $L_T$ and the area ($m^2$) of the inner section of the well 10 (in a transverse cut-plane) is denoted S.

If we consider the moment when the first interface 301 is located between the clusters of indexes p−1 and p, the conservation of fluid volume, under constant pressure, implies:

$$Q^{wh} = Sv + Q_1 \tag{1}$$

expression in which $Q^{wh}$ corresponds to the injection flowrate (which is expected to vary over time during the well closing phase 51) of the fluid injected in the well 10, $$Q_1 = \sum_{n=1}^{p-1} q_n^1$$

corresponds to the total injectivity of the first fluid 31 in the clusters of index $$1 \text{ to } p-1,\ q_n^1$$

corresponds to the local injectivity of the first fluid 31 in the cluster of index n.

Similarly, the conservation of fluid volume under the first interface 301 implies:

$$Sv = Q_2 \quad (2)$$

expression in which $$Q_2 = \sum_{n=p}^{N_c} q_n^2$$

corresponds to the total injectivity of the initial fluid 30 in the clusters of index $$p \text{ to } N_c,\ q_n^2$$

corresponds to the local injectivity of the initial fluid 30 in the cluster of index n, and $N_c$ corresponds to the total number of clusters of the well 10.

From expressions (1) and (2), we get:

$$Q^{wh} = Q_1 + Q_2 \quad (3)$$

When the first interface 301 has not reached yet the cluster of index 1, we have $Q_1=0$ and the speed of the first interface is $v=Q^{wh}/S$. On the other side of the well 10, when the first interface 301 has passed the cluster of index $N_c$ and has reached the second end 12 at depth $L_T$, we have $Q_2=0$ and the first interface 301 cannot travel further inside the well 10, v=0 and $Q^{wh}=Q_1$.

Hence, when the first interface 301 passes the cluster of index p, the total injectivity of the well 10 decreases by a quantity $$\delta Q_p = q_p^2 - q_p^1$$

and the injection flowrate $Q^{wh}$ decreases by the same quantity.

When the first fluid 31 has not reached yet the cluster of index 1, the injection flowrate $Q^{wh}$ is substantially constant. When the first interface 301 passes the cluster of index 1, the total injectivity of the well 10 decreases by a quantity $$\delta Q_1 = q_1^2 - q_1^1$$

and the injection flowrate $Q^{wh}$ decreases by the same quantity. Accordingly, when a variation of the measured injection flowrate $Q^{wh}$ is detected, this implies that the first interface 301 has reached the cluster of index 1, such that the detected quantity $\delta Q_1$ corresponds to the variation of the local injectivity associated to the depth (MD) of the cluster of index 1.

Similarly, between the cluster of index 1 and the cluster of index 2, the injection flowrate $Q^{wh}$ is substantially constant. When the first interface 301 passes the cluster of index 2, the total injectivity of the well 10 decreases by a quantity $$\delta Q_2 = q_2^2 - q_2^1$$

and the injection flowrate $Q^{wh}$ decreases by the same quantity. Accordingly, when another variation of the measured injection flowrate $Q^{wh}$ is detected, this implies that the first interface 301 has reached the cluster of index 2, such that the detected quantity $\delta Q_2$ corresponds to the variation of the local injectivity associated to the depth (MD) of the cluster of index 2. The same applies until the first interface 301 reaches the cluster of index $N_c$, each detected variation of the injection flowrate $Q^{wh}$ corresponding to the variation of the local injectivity associated to one of the clusters of the well 10.

Of course, the previous example may also be adapted to other well configurations. For instance, in the case of a well 10 having an open-hole configuration, an a priori partial knowledge of the geological formation may be obtained by, e.g., seismic measurements. Indeed, such seismic measurements may be used to obtain a model of the geological formation providing information of the different geological layers present in the geological formation, including the estimated depths of the interfaces between geological layers along the well 10, which can be used as an a priori partial knowledge of the depth injection profile of the well 10. While the injection flowrate $Q^{wh}$ might vary constantly over time during the well closing phase 51, the behavior of the variation of the injection flowrate $Q^{wh}$ should be modified when crossing an interface between geological layers, in particular if these geological layers have different permeabilities. Hence, detecting modifications of the behavior of the variation of the injection flowrate $Q^{wh}$ may be used to detect when an interface between geological layers are crossed, and to retrieve the corresponding depth.

However, it is also possible, in step 53, to estimate the depth injection profile of the well 10 based on at least one temporal injection profile without using an a priori partial knowledge of depth injection profile of the well 10.

For instance, it is possible to estimate the depth of the first interface 301 (respectively the second interface 312) successively in time, in order to be able to convert directly the time scale of the at least one temporal injection profile into an estimated depth scale. For instance, when performing the well closing phase 51 (respectively the well opening phase 52), it is possible to send at the first end 11 of the well 10 an acoustic wave which propagates in the well 10 and is at least partially reflected by the first interface 301 (respectively the second interface 312). By measuring the propagation time of the acoustic wave between its transmission at the first end 11 and the reception at the first end 11 of the echo corresponding to the reflected portion of the acoustic wave, it is possible to estimate the distance traveled by the acoustic wave and, accordingly, the depth of the first interface 301 (respectively the second interface 312). According to another example, it is possible to, e.g., measure the pressure at the second end 12 of the well 10. The variation of the pressure at the second end 12 may be used to estimate the depth (MD) of the first interface 301 (respectively the second interface 312). Although a pressure sensor needs to be installed at the second end 12, this is still less expensive and less risky than the operations required for using the tools of the prior art.

In the sequel, we provide an example of how the behavior of the fluids inside the well 10 may be modeled. The following example assumes in a non-limitative manner that the well 10 has a cased-hole configuration with several clusters of perforations 14, and that the temporal injection profile has been measured during the well closing phase 51. Although not detailed herein, the following example may also be adapted to other well configurations, and to the case of a temporal injection profile measured during the well opening phase 52.

During the well closing phase 51, the well 10 is initially filled with the initial fluid 30 which is progressively replaced by the first fluid 31. It is assumed that the first fluid 31 is injected while maintaining a constant injection pressure $P^{wh}$ at the first end 11, and $Q^{wh}$ corresponds to the injection flowrate (which may vary over time) of the fluid injected in the well 10. The depth (MD) of the first interface 301 along the well 10 is denoted 1. The depth TVD of the first interface 301 along the well 10 is denoted h. As introduced above, the total injectivity of the first fluid 31 into the geological formation is denoted $Q_1$ and the total injectivity of the initial fluid 30 into the geological formation is denoted $Q_2$.

Initially, i.e., before starting the well closing phase 51, it is assumed that the well 10 is statically at equilibrium with a pressure $$P_0^{wh}$$

at the first end 11. The pressure $P_n$ inside the well 10 at the level of each cluster of index n may be expressed as:

$$P_n(x_n, 0) = P_0^{wh} + \rho_2^0 g z_n \tag{4}$$

expression in which $$\rho_2^0$$

is the average density of the initial fluid 30 between the first end 11 and the true vertical depth (TVD) $z_n$, of the considered cluster, and g corresponds to the gravitational acceleration.

During the well closing phase 51, we denote by $P_1$ (x) and $P_2$ (x) the respective pressures of the first fluid 31 and of the initial fluid 30 at the depth (MD) x. For the first fluid 31, we have:

$$P_1(x) = P^{wh} + \rho_1 g z + \Delta P_1(x),\ 0 \le x \le l \tag{5}$$

expression in which $p_1$ is the average density of the first fluid 31 between the first end 11 and the first interface 301, z is the depth TVD of the considered point of the well 10 at depth (MD) x, and $\Delta P_1(x)$ is the load loss in the first fluid 31 between the first end 11 and the considered point of the well 10 at depth (MD) x.

Similarly, we have for the initial fluid 30:

$$P_2(x) = P_i + \rho_2 g(z - h) + \Delta P_2(x),\ l \le x \le L_T \tag{6}$$

expression in which $p_2$ is the average density of the initial fluid 30 between the first interface 301 and the considered point of the well 10 at depth TVD z; h is the depth TVD of the first interface 301, $P_i = P_1(\iota) = P_2(\iota)$ is the pressure at the first interface 301, and $\Delta P_2$ (X) is the load loss in the initial fluid 30 between the first interface 301 the considered point of the well 10 at depth (MD)x.

Figure 6:
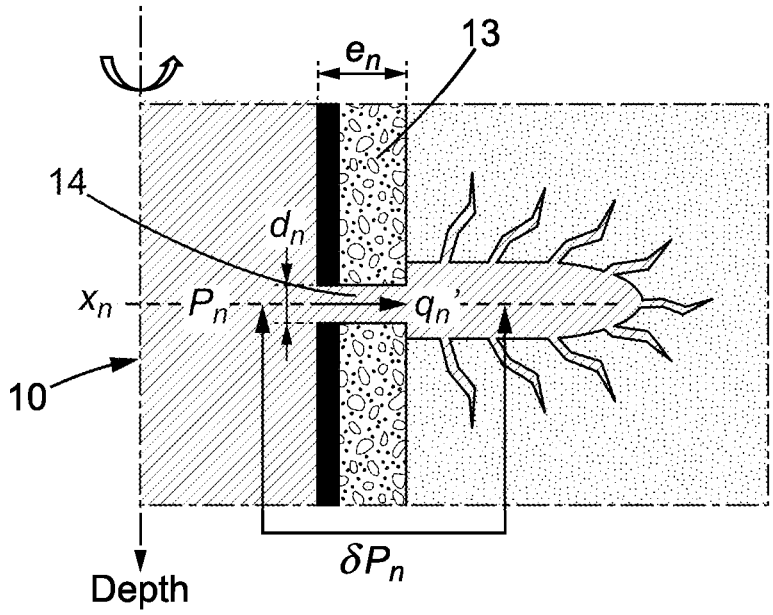
FIG. 6 is a schematic representation of a partial cross-sectional view of the well, in a portion comprising a perforation.

FIG. 6 represents schematically a partial cross-sectional view of a cluster of index n of the well 10, having a depth (MD) $x_n$. As can be seen in FIG. 6, each cluster may be assumed to correspond to a perforation 14 having a diameter $d_n$ and extending through the casing 13 (both cemented and metallized in FIG. 6) which has a thickness $e_n$. This perforation 14 puts the inner volume of the well 10 in fluid communication with the geological formation. The local injectivity $q_n$ through the cluster of index n is related to the pressure differential $\delta P_n$ at the corresponding depth (MD) $x_n$, and is given by:

$$\delta P_n = P_n(x_n, t) - P_n^f(t) \tag{7}$$

expression in which $$P_n^f$$

is the pressure at the extremity of the perforation 14, inside the geological formation.

In the sequel, it is assumed that the geological formation comprises, at the level of each cluster, a highly developed fracture, such that it is highly compressible and has a substantially constant pressure. In other words:

$$P_n^f(t) = P_n^f(0) = P_n(x_n, 0) \tag{8}$$

The speed $u_n$ of the fluid in the perforation 14 of the cluster of index n is related to the pressure differential by the Darcy-Weisbach relation:

$$\delta P_n = \rho f_n e_n \frac{u_n^2}{2d_n} \tag{9}$$

expression in which p is the density of the fluid travelling through the perforation 14 of the cluster of index n, $f_n$ is the friction factor of the perforation 14 of the cluster of index n.

Assuming the fluid (either the first fluid 31 or the initial fluid 30) is a Newtonian fluid, with a turbulent regime flow and a smooth perforation, the friction is given by the following approximation:

$$f_n = 0{,}3164/\mathrm{Re}_n^{0{,}25} \tag{10}$$

expression in which $Re_n$ corresponds to the Reynold's number. The Reynold's number depends on the density ρ of the fluid, on its dynamic viscosity μ, on the area of the section $s_n$ of the perforation 14 of the cluster of index n and its diameter $d_n$, and on the local injectivity $q_n'$ of the perforation:

$$Re_n = \frac{\rho u_n d_n}{\mu} = \frac{\rho q'_n d_n}{\mu s_n} \tag{11}$$

In general, for a Newtonian fluid, the regime flow is considered to be turbulent (as assumed here) if $Re_n>3000$.

According to expression (9), the speed of the fluid in the perforation 14 is related to the pressure differential by the following expression:

$$u_n = \sqrt{\frac{2d_n}{f_n e_n}\frac{\delta P_n}{\rho}} \tag{12}$$

and the local injectivity $q_n$ in the cluster of index n is given by the expression:

$$q_n = N_p q'_n = N_p u_n s_n \tag{13}$$

expression in which $N_p$ corresponds to the number of perforations per cluster (assumed in a non-limitative manner to be the same for all clusters).

From equations (10), (11) and (12), we get:

$$q_n = 2.25 N_p\left(\frac{d_n^{19}\delta P_n^4}{e_n^4\rho^3\mu}\right)^{\frac{1}{7}} \tag{14}$$

Hence, with two Newtonian fluids having the same density and respective different viscosities, their local injectivity ratio in the same perforation/cluster is inversely proportional to their viscosity ratio at the power 1/7. For example, in case the first fluid 31 is a linear gel having a viscosity equal to 50 cP and the initial fluid 30 is water with a viscosity equal to 1 cP (i.e., the viscosity of the first fluid 31 is 50 times higher than the viscosity of the initial fluid 30), then the local injectivity of the first fluid 31 is 1.75 times smaller than the local injectivity of the initial fluid 30.

It should be noted that the present disclosure is not limited to Newtonian fluids having a turbulent flow regime in a smooth perforation, and other expressions can be derived for, e.g., other types of fluids (nonlinear fluids, etc.), other types of flow regimes, etc.

At each time t, it is possible to compute the pressure distribution inside the well 10, which determines the load loss (or pressure differential) MI at the level of each perforation 14, assuming a highly developed fracture in the geological formation such that it is highly compressible and has a substantially constant pressure. In that case, we get from expressions (7) and (8):

$$\delta P_n = P_n(x_n, t) - P_n(x_n, 0) \tag{15}$$

and the local injectivity $q_n$ of the cluster of index n can be computed using expression (14).

As discussed above, when the first interface 301 passes the cluster of index p, the total injectivity of the well 10 decreases by a quantity $$\delta Q_p = q_p^2 - q_p^1$$

and the injection flowrate $Q^{wh}$ decreases by the same quantity.

In case of Newtonian fluids, turbulent flow regime and smooth perforations, $\delta Q_p$ can be expressed by using expression (14) as:

$$\delta Q_p = 2.25 N_p\left(\frac{d_p^{19}\delta P_p^4}{e_p^4}\right)^{\frac{1}{7}}\left(\frac{1}{\mu_2\rho_2^3} - \frac{1}{\mu_1\rho_1^3}\right)^{\frac{1}{7}} \tag{16}$$

expression in which:

$p_1$ corresponds to the density of the first fluid 31;

$p_2$ corresponds to the density of the initial fluid 30;

$\mu_1$ corresponds to the viscosity of the first fluid 31; and $\mu_2$ corresponds to the viscosity of the initial fluid 30.

The load losses in the well 10 vary during the well closing phase 51. The speed of the fluids is not uniform along the depth (MD) of the well 10. At each time step, the load losses have to be calculated to determine the new distribution of the pressure inside the well 10, in particular at the level of each cluster, which pressure determines in part the local injectivity of each cluster. In the sequel, we assume in a non-limitative manner that the load loss for the initial fluid 30 is negligible ($\Delta P_2=0$).

We first consider the first subphase of the well closing phase 51 which corresponds to the subphase during which the first fluid 31 is injected until it reaches the cluster of index 1. During this subphase, all the clusters are covered by the initial fluid 30, and we have $Q_1=0$ and $Sv_1=Q_2=Q^{wh}$.

Along the well 10, the load loss $\Delta P_1$ may be expressed as:

$$\Delta P_1 = f_1^1 \rho_1 l \frac{v_1^2}{2D} \tag{17}$$

expression in which $v_1$ is the speed of the first fluid 31 for the first subphase, $$f_1^1$$

is the friction factor for the first fluid 31 and the cluster of index 1 which, according to expression (10) above, corresponds to $$f_1^1 = 0{,}3164/\mathrm{Re}_1^{1\,0{,}25},$$

with $$\mathrm{Re}_1^1$$

the Reynold's number:

$$Re_1^1 = \frac{\rho_1 v_1 d_1}{\mu_1} \tag{18}$$

Figure 7:
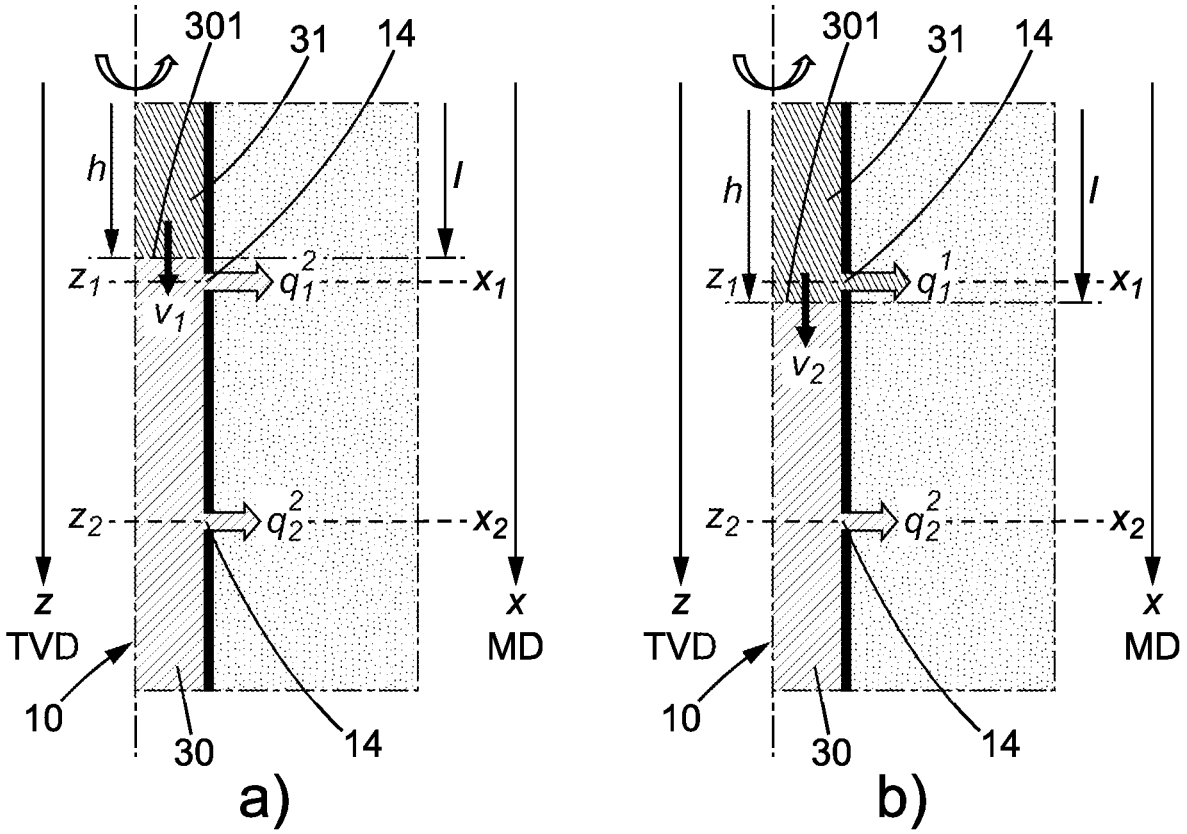
FIG. 7 are schematic representations of partial cross-sectional views of the well, in a portion comprising perforations, showing the displacement of an interface between different fluids inside the well.

We now consider the second subphase of the well closing phase 51 which corresponds to the subphase during which the first interface 301 passes the cluster of index 1, in reference to FIG. 7, which represents schematically partial cross-sectional views of the well 10.

When the first interface reaches the cluster of index 1 at depth (MD) $x_1$ (depth TVD $z_1$), the first interface 301 has a speed $v_1=Q^{wh}/S$ (part a) of FIG. 7). After having passed the cluster of index 1 (part b) of FIG. 7), the local injectivity of said cluster decreases from $$q_1^1$$

(covered by the initial fluid 30, e.g., water) to $$q_1^2$$

(covered by first fluid 31, e.g., viscous gel), and the speed of the first fluid 31 is also decreased to $$v_2 = v_1 - (q_1^2 - q_1^1)/S.$$

As discussed above, the total injectivity of the well 10 decreases by a quantity $$\delta Q_1 = q_1^2 - q_1^1.$$

We now consider the third subphase of the well closing phase 51 which corresponds to the subphase during which the first interface 301 travels between the cluster of index 1 and the cluster of index 2.

In the third subphase, two portions are to be distinguished for computing the load losses.

For $0 \le x \le x_1$, i.e., the portion from the first end 11 to the cluster of index 1, the speed of the first fluid 31 is $v_1=Q^{wh}/S$ and the load loss $$\Delta P_1^1$$

in this portion is given by:

$$\Delta P_1^1 = f_1^1 \rho_1 x_1 \frac{v_1^2}{2D} \tag{19}$$

For $x_1 \le x \le l$, i.e., the portion between the cluster of index 1 and the first interface 301, the speed of the first fluid 31 is $$v_2 = v_1 - (q_1^2 - q_1^1)/S$$

and the load loss $$\Delta P_1^2$$

in this portion is given by:

$$\Delta P_1^2 = f_2^1 \rho_1 (l - x_1) \frac{v_2^2}{2D} \tag{20}$$

The total load loss for the first fluid 31 in the well 10 is:

$$\Delta P_1 = \Delta P_1^1 + \Delta P_1^2 \tag{21}$$

We now consider the fourth subphase of the well closing phase 51 which corresponds to the subphase during which the first interface 301 passes the cluster of index 2. When the first interface 301 reaches the cluster of index 2 at depth (MD) $x_2$ (depth TVD $z_2$), the first fluid 31 has a speed $v_2$. After passing the cluster of index 2, the local injectivity decreases from $$q_2^1$$

(covered by the initial fluid 30) to $$q_2^2$$

(covered by the first fluid 31), and the speed of the first interface further decrease to $$v_3 = v_2 - (q_2^2 - q_2^1)/S.$$

As discussed above, the total injectivity of the well 10 decreases by a quantity $$\delta Q_2 = q_2^2 - q_2^1.$$

We now consider the fifth subphase of the well closing phase 51 which corresponds to the subphase during which the first interface 301 travels between the cluster of index 2 and the cluster of index 3.

In the fifth subphase, three portions are to be distinguished for computing the load losses.

For $0 \le x \le x_1$, i.e., the portion from the first end 11 to the cluster of index 1, the speed of the first fluid 31 is $v_1=Q^{wh}/S$ and the load loss $$\Delta P_1^1$$

in this portion is given by:

$$\Delta P_1^1 = f_1^1 \rho_1 x_1 \frac{v_1^2}{2D} \tag{22}$$

For $x_1 \le x \le x_2$, i.e., the portion between the cluster of index 1 and the cluster of index 2, the speed of the first fluid 31 is $$v_2 = v_1 - (q_1^2 - q_1^1)/S$$

and the load loss $$\Delta P_1^2$$

in this portion is given by:

$$\Delta P_1^2 = f_2^1 \rho_1 (x - x_1) \frac{v_2^2}{2D} \tag{23}$$

For $x_2 \leq x \leq 1$, i.e., the portion between the cluster of index 2 and the first interface 301, the speed of the first fluid 31 is $$v_3 = v_2 - (q_2^2 - q_2^1)/S$$

and the load loss $$\Delta P_1^3$$

in this portion is given by:

$$\Delta P_1^3 = f_3^1 \rho_1 (l - x_2) \frac{v_3^2}{2D} \tag{24}$$

The total load loss for the first fluid 31 in the well 10 is:

$$\Delta P_1 = \Delta P_1^1 + \Delta P_1^2 + \Delta P_1^3 \tag{25}$$

For the following subphases, the previous pattern can be repeated until the last cluster of index $N_c$, and the second end 12 of the well 10. Once the second end 12 of the well 10 reached by the first fluid 31, the first interface 301 cannot travel deeper in the well 10, and the pressure distribution inside the well 10 and the local injectivities of each cluster stabilize themselves.

Based on the previous equations, it is possible to model the behavior of the fluids inside the well 10 during the well closing phase 51. Similar equations can also be derived for the well opening phase 52. For instance, it is possible to simulate beforehand the behavior of the fluids inside the well 10 in order to select the value(s) of the injection flowrate setpoint(s) or injection pressure setpoint(s).

It should be noted that the depth injection profile estimated can take many different representations, as long as it is representative of the variation of the injectivity of the well 10 along the well's depth (MD). For instance, the depth injection profile may be a cumulative injection profile which provides, for each depth (MD) x of the well 10, the cumulated injectivity of the portion of the well 10 between the first end 11 and the depth x. According to another example, the depth injection profile may be a local injectivity distribution along the well's depth (MD), which provides, e.g., the local injectivity of each cluster. Also, the injectivity may be provided as relative values (e.g., expressed as $$\delta Q_p = q_p^2 - q_p^1$$

for each cluster, or as a distribution in percentages of the total injectivity of the well 10 among the clusters) or absolute values (e.g., expressed as $$q_p^2$$

or $$q_p^1$$

for each cluster), etc. For instance, absolute values of the local injectivity $$q_p^2$$

may be obtained by using equation (16):

$$\delta Q_p = \left(1 - \frac{q_p^1}{q_p^2}\right) q_p^2 = \left(1 - \left(\frac{\rho_2}{\rho_1}\right)^{\frac{3}{7}} \left(\frac{\mu_2}{\mu_1}\right)^{\frac{1}{7}}\right) q_p^2 \tag{26}$$

Hence, the local injectivity $$q_p^2$$

of the initial fluid 30 for the cluster of index p may be obtained from the quantity $\delta Q_p$ measured for the cluster of index p by using the following expression:

$$q_p^2 = \frac{\delta Q_p}{\left(1 - \left(\frac{\rho_2}{\rho_1}\right)^{\frac{3}{7}} \left(\frac{\mu_2}{\mu_1}\right)^{\frac{1}{7}}\right)} \tag{27}$$

In some embodiments, the estimating system 20 according to the present disclosure may be used in a system for recovering hydrocarbons from a geological formation, said system comprising both the well 10 and said estimating system 20. In such a case, the well 10 is used for hydrocarbons recovery, alone or in a pair of wells (either as a production well or as an injection well), and the estimating system 20 is used to perform well production logging operations. The estimated depth injection profile is then used for recovering hydrocarbons from the geological formation.

It is emphasized that the present disclosure is not limited to the above exemplary embodiments. Variants of the above exemplary embodiments are also within the scope of the present disclosure.

The various embodiments described above can be combined to provide further embodiments. All of the patents and patent application publications referred to in this specification and/or listed in the Application Data Sheet are incorporated herein by reference, in their entirety. Aspects of the embodiments can be modified, if necessary to employ concepts of the various patents and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A method for estimating an injection profile in function of the depth of a well, said well being used for reaching a geological formation, the well extending between a first end of the well and a second end of the well, said first end being located towards a surface level of the well, said method comprising:

performing, when the well is initially filled with an initial fluid:

a well closing phase which comprises injecting a first fluid at the first end until said first fluid reaches the second end, such that a first interface between the initial fluid and the first fluid travels from the first end towards the second end such that the well is completely filled with the first fluid and the initial fluid has been completely injected into the geological formation when the first interface reaches the second end, wherein said first fluid has a higher viscosity than the initial fluid; and a well opening phase which comprises injecting a second fluid at the first end until said second fluid reaches the second end, such that a second interface between the first fluid and the second fluid travels from the first end towards the second end such that the well is completely filled with the second fluid and the first fluid has been completely injected into the geological formation when the second interface reaches the second end, wherein said first fluid has a higher viscosity than the second fluid;

the method further comprising:

measuring at least one temporal injection profile representative of a variation over time of at least one physical quantity measured at the first end during the well closing phase or the well opening phase; and estimating a depth injection profile of the well based on the at least one temporal injection profile.

2. The method according to claim 1, wherein a first temporal injection profile is measured for the first fluid during the well closing phase and a second temporal injection profile is measured for the second fluid during the well opening phase, and wherein the depth injection profile of the well is estimated based on both the first temporal injection profile and the second temporal injection profile.

3. The method according to claim 2, wherein a first depth injection profile is estimated based on the first temporal injection profile and a second depth injection profile is estimated based on the second temporal injection profile, and wherein the depth injection profile of the well is estimated based on both the first depth injection profile and the second depth injection profile.

4. The method according to claim 2, wherein a first depth injection profile is estimated based on the first temporal injection profile and a second depth injection profile is estimated based on the second temporal injection profile, the method further comprising evaluating a consistency of measurements of the at least one physical quantity by comparing the first depth injection profile and the second depth injection profile.

5. The method according to claim 1, wherein:

the first fluid is a gel; and/or the second fluid is water or brine.

6. The method according to claim 1, wherein the initial fluid has the same viscosity as the second fluid.

7. The method according to claim 1, wherein the first fluid has a same density as the second fluid.

8. The method according to claim 1, wherein the at least one physical quantity measured corresponds to at least one of an injection flowrate at the first end or an injection pressure at the first end.

9. The method according to claim 8, wherein measuring the at least one temporal injection profile comprises:

measuring, at the first end, the injection flowrate of the first or second fluid while maintaining a constant injection pressure at the first end during at least a part of the well closing phase or of the well opening phase; or measuring, at the first end, the injection pressure of the first or second fluid while maintaining a constant injection flowrate at the first end during at least a part of the well closing phase or of the well opening phase.

10. The method according to claim 9, wherein measuring the at least one temporal injection profile is performed over successive time intervals having different respective constant injection pressure setpoints or different respective constant injection flowrate setpoints.

11. The method according to claim 1, further comprising:

using the estimated depth injection profile for hydrocarbon recovery by the well from the geological formation.

12. A system for estimating a depth injection profile of a well, said well being used for reaching a geological formation, the well extending between a first end of the well and a second end of the well, said first end being located towards a surface level of the well, the system comprising:

means configured to perform, when the well is initially filled with an initial fluid:

a well closing phase during which the system injects a first fluid at the first end until said first fluid reaches the second end, such that a first interface between the initial fluid and the first fluid travels from the first end towards the second end such that the well is completely filled with the first fluid and the initial fluid has been completely injected into the geological formation when the first interface reaches the second end, wherein said first fluid has a higher viscosity than the initial fluid; and a well opening phase during which the system injects a second fluid at the first end until said second fluid reaches the second end, such that a second interface between the first fluid and the second fluid travels from the first end towards the second end such that the well is completely filled with the second fluid and the first fluid has been completely injected into the geological formation when the second interface reaches the second end, wherein said first fluid has a higher viscosity than the second fluid;

the system further comprising:

means configured to measure at least one temporal injection profile representative of a variation over time of at least one physical quantity measured at the first end during the well closing phase or the well opening phase; and means configured to estimate the depth injection profile of the well based on the at least one temporal injection profile.

13. The system according to claim 12, wherein the means configured to measure the at least one temporal injection profile is configured to measure a first temporal injection profile for the first fluid during the well closing phase and a second temporal injection profile for the second fluid during the well opening phase, and wherein the means configured to estimate the depth injection profile of the well is configured to estimate the depth injection profile of the well based on both the first temporal injection profile and the second temporal injection profile.

14. The system according to claim 13, wherein the means configured to estimate the depth injection profile of the well is configured to estimate a first depth injection profile based on the first temporal injection profile and a second depth injection profile based on the second temporal injection profile, wherein the depth injection profile of the well is estimated based on both the first depth injection profile and the second depth injection profile.

15. The system according to claim 13, wherein the means configured to estimate the depth injection profile of the well is configured to estimate a first depth injection profile based on the first temporal injection profile and a second depth injection profile based on the second temporal injection profile, the system further comprising means to evaluate a consistency of measurements of the at least one physical quantity by comparing the first depth injection profile and the second depth injection profile.

16. The system according to claim 12, wherein:

the first fluid is a gel; and/or the second fluid is water or brine.

17. The system according to claim 12, wherein the initial fluid has the same viscosity as the second fluid.

18. The system according to claim 12, wherein the first fluid has a same density as the second fluid.

19. The system according to claim 12, wherein the at least one physical quantity measured corresponds to at least one of an injection flowrate at the first end or an injection pressure at the first end.

20. The system according to claim 19, wherein the means configured to measure the at least one temporal injection profile comprises:

means for measuring, at the first end, the injection flowrate of the first or second fluid while maintaining a constant injection pressure at the first end during at least a part of the well closing phase or of the well opening phase; or means for measuring, at the first end, the injection pressure of the first or second fluid while maintaining a constant injection flowrate at the first end during at least a part of the well closing phase or of the well opening phase.

21. The system according to claim 20, wherein the means configured to measure the at least one temporal injection profile comprises means for measuring the at least one temporal injection profile over successive time intervals having different respective constant injection pressure setpoints or different respective constant injection flowrate setpoints.

22. The system according to claim 12, further comprising means configured to use the estimated depth injection profile for hydrocarbon recovery by the well from the geological formation.

23. The system according to claim 22, wherein the well comprises a casing extending between the first end and the second end, said casing comprising lateral perforations for connecting an inner volume of the casing with the geological formation.

* * * * *